US006209464B1

(12) United States Patent
Elder

(10) Patent No.: US 6,209,464 B1
(45) Date of Patent: Apr. 3, 2001

(54) INDEXED PALLET

(75) Inventor: Andrew W. Elder, Carmel, IN (US)

(73) Assignee: Stratis Corporation, Indianapolis, IN (US)

( * ) Notice: Subject to any disclaimer, the term of this patent is extended or adjusted under 35 U.S.C. 154(b) by 0 days.

(21) Appl. No.: 09/253,624

(22) Filed: Feb. 19, 1999

(51) Int. Cl.[7] ..... B65D 19/38
(52) U.S. Cl. ..... 108/53.3
(58) Field of Search ..... 108/53.1, 53.3, 108/53.5, 56.1, 57.29, 54.1

(56) References Cited

U.S. PATENT DOCUMENTS

D. 256,904 * 9/1980 Persson .
D. 267,126 * 11/1982 Jonebrant .
D. 283,267 * 4/1986 Kero et al. .
D. 289,939 * 5/1987 Dash .
D. 371,670 * 7/1996 Carlsson .
D. 374,536 * 10/1996 Elder et al. .
D. 393,519 * 4/1998 Wail et al. .
D. 400,681 * 11/1998 Sadr .
D. 404,179 * 1/1999 Apps et al. .
D. 408,610 * 4/1999 Mathias .
1,349,458 * 8/1920 Johnson .
2,451,226 10/1948 Kemp, Jr. .
2,662,711 12/1953 Lapham .
3,204,583 * 9/1965 Nicholson .
3,561,375 * 2/1971 Hammond .
3,636,889 * 1/1972 Mangold .
3,719,157 3/1973 Arocha et al. .
3,720,176 * 3/1973 Munroe .
3,750,596 * 8/1973 Box .
3,762,342 * 10/1973 Lawlor .
3,926,321 * 12/1975 Trebilcock .
3,944,070 * 3/1976 Cardwell et al. ..... 108/53.1 X
3,962,660 * 6/1976 Duckett .
4,000,704 * 1/1977 Griffin, Jr. ..... 108/53.3 X
4,198,795 * 4/1980 Barnidge .
4,226,192 * 10/1980 Myers ..... 108/53.3 X
4,301,743 * 11/1981 Keller .
4,480,748 * 11/1984 Wind ..... 108/55.3 X
4,674,414 * 6/1987 Nulle et al. ..... 108/53.3
4,694,962 * 9/1987 Taub ..... 108/54.1 X
4,879,956 * 11/1989 Shuert ..... 108/53.3
5,052,307 * 10/1991 Morrison .
5,476,048 * 12/1995 Yamashita et al. .
5,809,902 * 9/1998 Zetterberg .

FOREIGN PATENT DOCUMENTS 298 21 779 U1 3/1999 (DE) .

* cited by examiner

*Primary Examiner*—Jose V. Chen
(74) *Attorney, Agent, or Firm*—Merchant & Gould P.C.

(57) ABSTRACT

A pallet includes a rectangular support deck having a substantially planar upper supporting surface including a plurality of channels formed therein extending across the pallet. The deck includes support members extending from an underside of the deck that nest in recesses formed in the upper surface of the deck. An alignment portion is formed at a center point along the first edge of the deck and a second alignment portion is formed at a center point of an opposed edge of the deck. An alignment portion includes angled sides for receiving a tapered member of a complementary device.

18 Claims, 8 Drawing Sheets

INDEXED PALLET

BACKGROUND

1. Field of the Invention

The present invention relates to a pallet and in particular, to an indexed pallet and alignment system for aiding in positioning the pallet for loading and unloading.

2. Prior Art

Pallets for supporting various types of articles are well known. Pallets are made of many materials including wood, metal, fiberglass or molded plastic, depending on the intended use and environments in which the pallets are used. Pallets generally provide a support for many different types of articles and are adapted for use with many types of loading equipment, including attachment to cranes or lifting from below by forklifts or manual pallet jacks.

Pallets are often constructed with a planar supporting upper surface and feet, runners or other supports extending downward from below the planar support portion. In this manner, articles are raised off of the ground to prevent moisture, dirt and other debris from coming into contact with the supported articles. When not in use, the pallets are typically stored in a stacked configuration. The stacks may become very high and the amount of space required for storing the pallets may be quite expansive.

Pallets often require precise positioning of the articles for loading and unloading. Often channels are formed across the supporting surface so that tines or extended fingers may fit under the supported articles into the channels for aiding with alignment. However, this method may introduce imprecision due to variances and tolerances in the channels into which the tines or fingers extend in aligning and positioning of the articles for loading and unloading. This problem can be compounded if measurements are taken from different positions, such as opposite ends of the pallet.

It can be seen then that a pallet is needed that is capable of supporting heavy loads and provides maximum support area that does not damage articles being supported and are stackable when not in use. In addition, such pallets should provide for alignment of the pallets for loading and unloading in a precise manner without detracting from the utility of the pallet. Such an alignment system should prevent misalignment due to differences in tolerances from one end to the other of the pallet.

SUMMARY

The present invention is directed to a stackable pallet and in particular, to a pallet that includes an alignment portion to aid in precisely positioning the pallet.

The pallet may be made of a molded plastic or other similar material that is light weight and provides sufficient strength to accommodate the anticipated loads. The pallet includes a deck with a substantially planar upper surface and support portion extending downward from an underside of the deck. The upper surface may include channels formed therein and extending across the width of the deck. Ribs extending on the underside of the deck preferably run crosswise to the channels so that the deck has improved strength and rigidity. The underside of the deck may also include indentations for receiving the support portions of adjacent pallets stacked in a flip-flop configuration so that the supports of one pallet inserted into the indentations of an adjacent inverted nested pallet. In this manner, the pallets may be stacked and a nested, alternately inverted pattern requiring less overall height and less space for the stored pallets. The bottom of the support portions are configured to also extend into recesses formed in the upper surface of the deck so that the decks nest slightly in a normal stacked configuration. This retards lateral sliding of the decks and provides alignment so that the stack is less likely to tip.

In addition, the pallets of the present invention include an alignment notch formed along the center line of one of the lengthwise edges of the pallet. The alignment notch has angling sides which align with and receive a complementary alignment member from a device from the structure with which the pallet is being aligned. The angling sides provide for a degree of self correcting alignment. With the notch along the center line, the tolerances and variations are decreased as aligning is always taken from the center point rather than one of the ends where variances and tolerances may compound.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
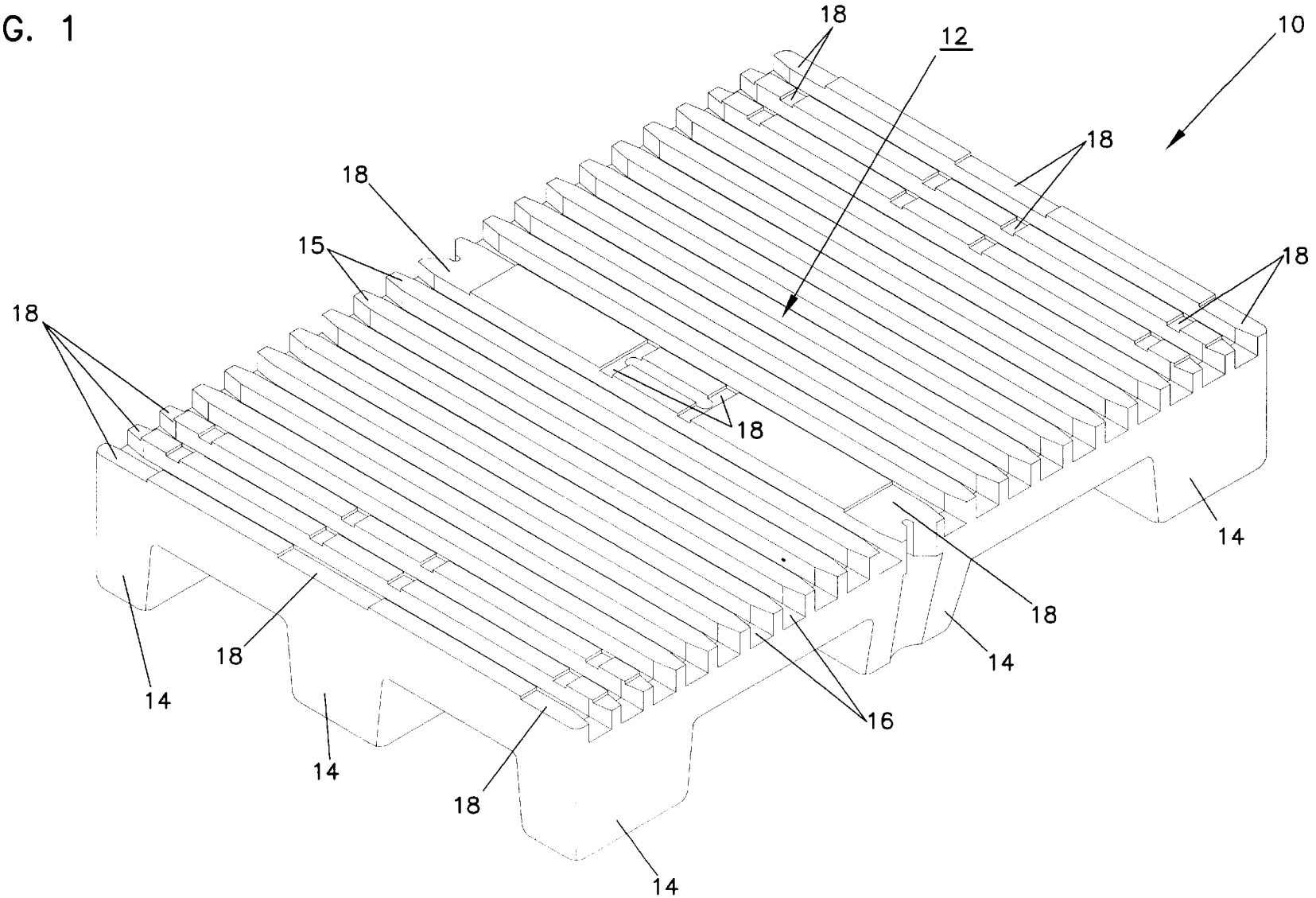
FIG. 1 shows a perspective view of a first embodiment of a pallet according to the principles of the present invention.
Figure 3:
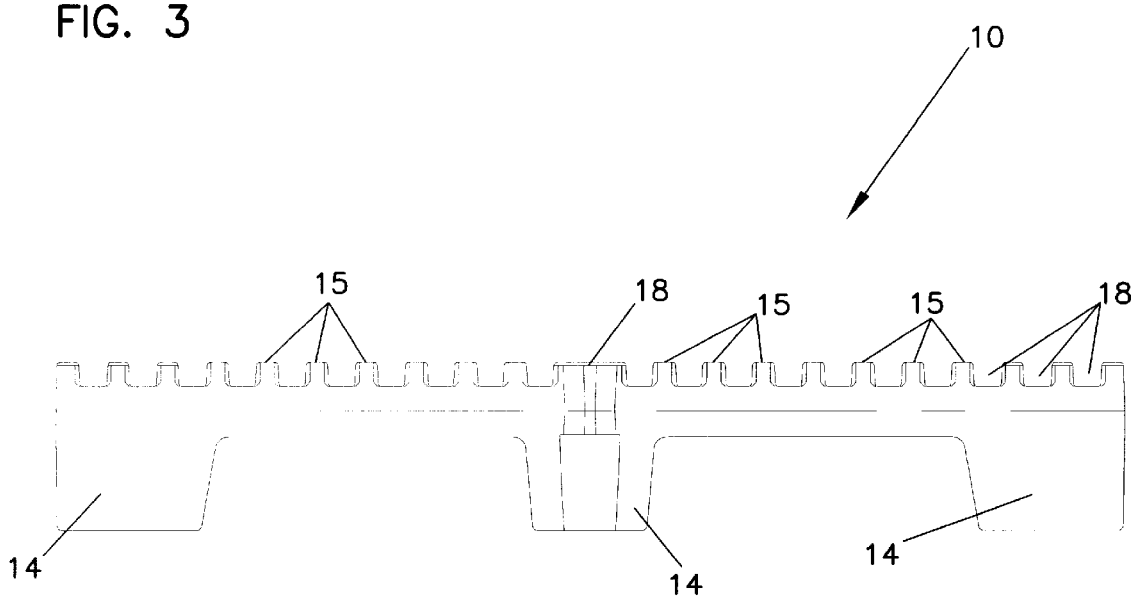
FIG. 3 is a side elevational view of the pallet shown in FIG. 1.
Figure 4:
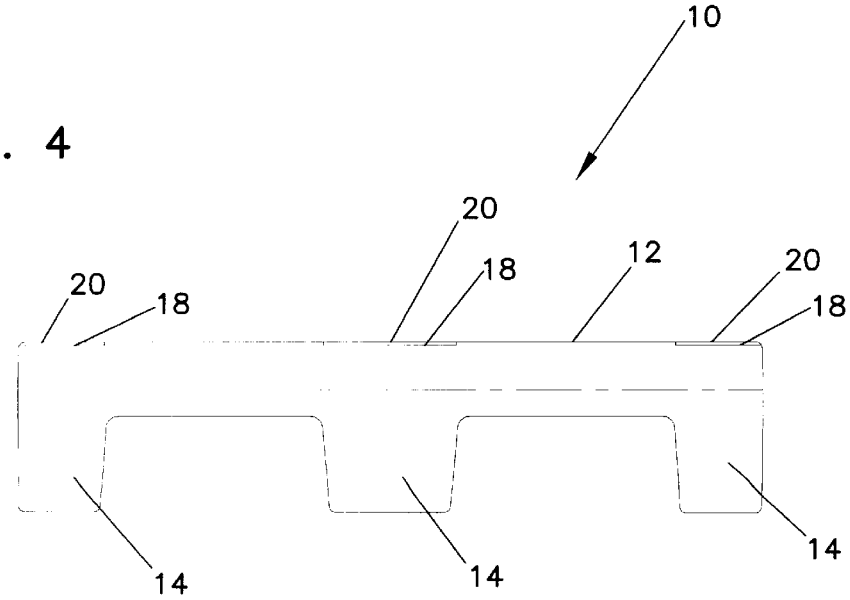
FIG. 4 is an end elevational view of the pallet shown in FIG. 1.

Referring now to FIG. 1, there is shown a pallet, generally designated 10. The pallet includes a deck portion 12 having a substantially planar upper surface and may include ribs 15 and channels 16 extending across the upper surface. The channels 16 may receive supports or lifting devices for the load. The ends of the ribs 15 are tapered to aid insertion. The pallet 10 includes support members 14 extending downward from an underside of the deck 12. The support portions 14 are spaced apart from one another to provide a wide stable base for the pallet and adapted to receive forklift tines and manual pallet jacks. The supports 14 at the corner include vertical sides that are substantially flush with the edges of the deck 12, as shown in FIGS. 3 and 4.

Figure 2:
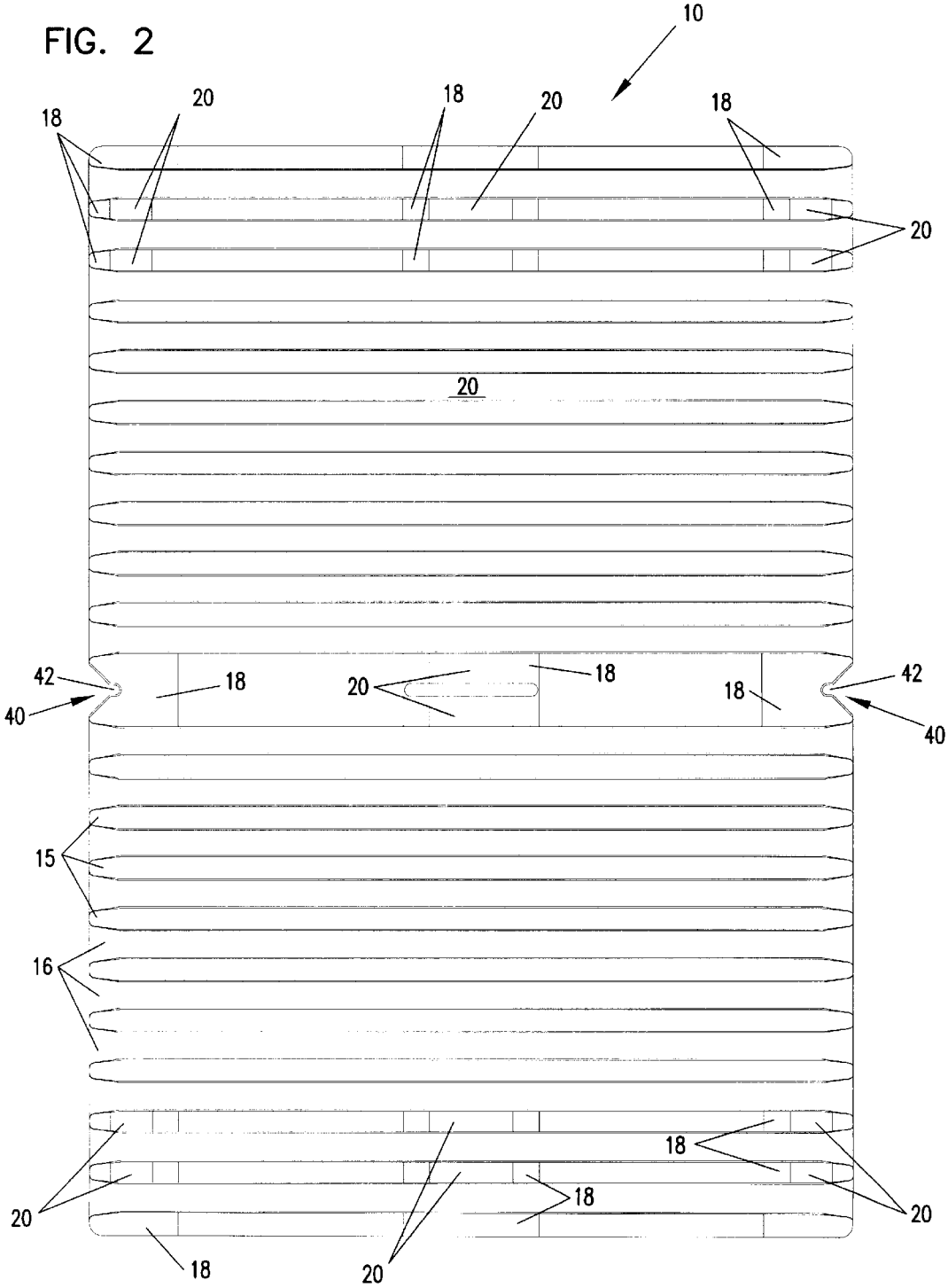
FIG. 2 is a top plan view of the pallet shown in FIG. 1.
Figure 5:
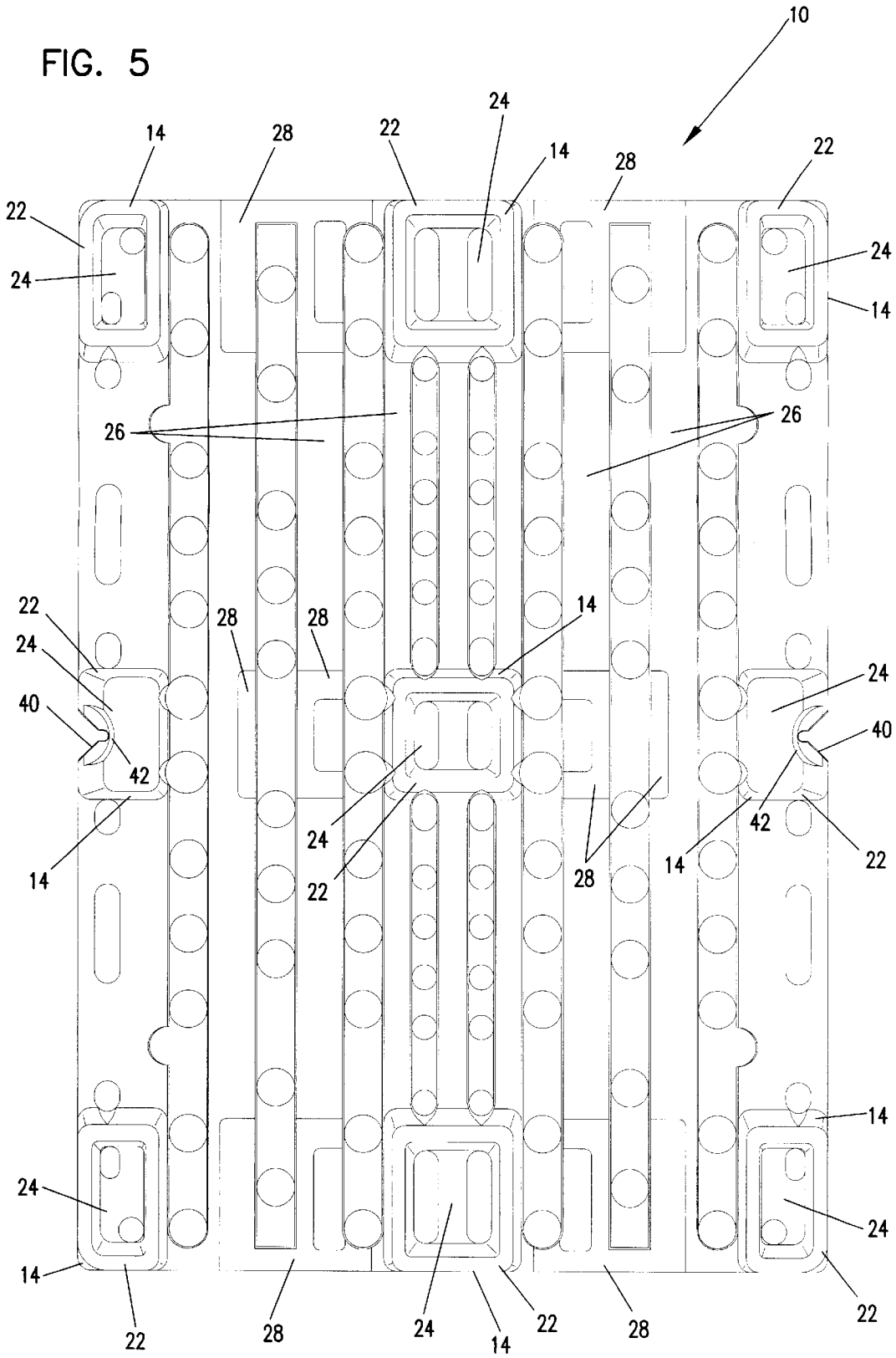
FIG. 5 is a bottom plan view of the pallet shown in FIG. 1.

As also shown in FIG. 2, the upper surface of the deck 12 includes recesses 18 formed for nesting of the pallets 10 when stacked. The recesses 18 define center portions 20 extending to the upper surface of the deck 12 that are configured for nesting and aligning with bottom depressions 24 and lower surfaces formed in the bottom of the support portions 14, shown in FIG. 5. The lower surfaces 22 of the support portions 14 have a profile complementary to the recesses 18 so that the pallets 10 nest when stacked to prevent lateral movement between stacked pallets 10. Referring again to FIG. 5, the underside of the pallet 10 includes bottom support ribs 26 extending across the length of the pallet. The ribs 26 extend perpendicular to the ribs 15 and channels 16 on the top of the deck 12 for improved support and rigidity. The nesting recesses 18 also provide compatibility with the channels 16 and preferably extend to a depth no greater than the channels 16.

The underside of the deck 12 includes cavities 28 formed therein that are spaced and configured for receiving lower surfaces 22 of the support portions 14. In this manner, pairs of the pallets 10 may be stacked in a flip-flop configuration with greater nesting occurring. The pairs of pallets 10 are stacked slightly offset to one another so that the support portions 14 of one pallet 10 align with and extend into the bottom cavities 28 of an inverted adjacent pallet 10. This configuration prevents lateral sliding between pairs of complementary pallets 10, requiring less space for pallet storage and shipping.

Figure 6:
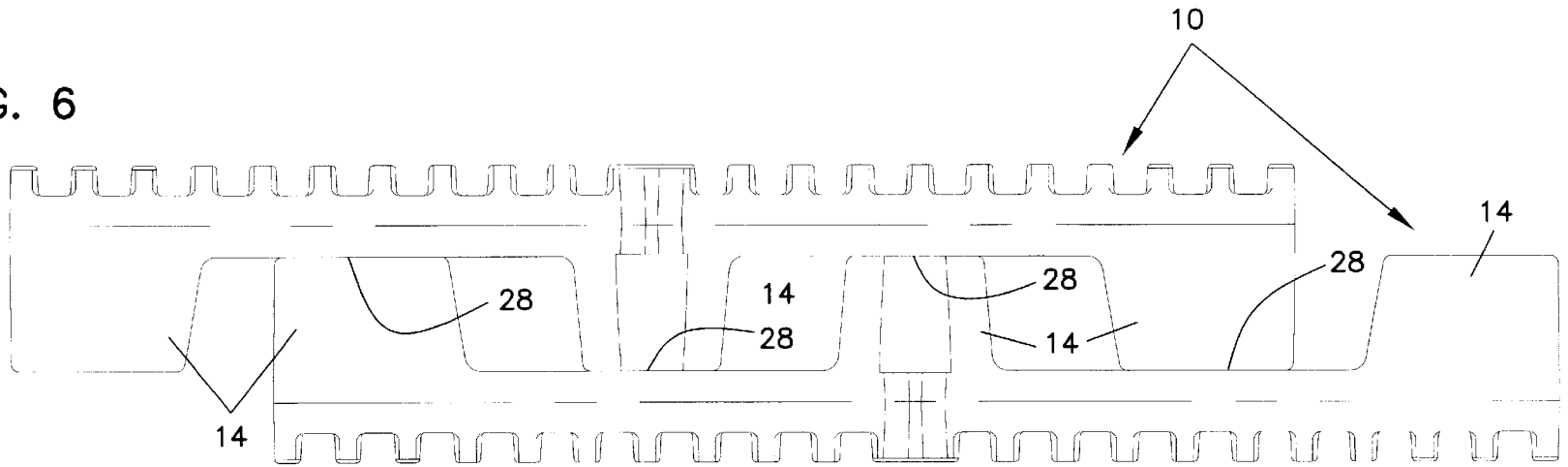
FIG. 6 is a side elevational view of pallets shown in FIG. 1 in a stacked, nested configuration.
Figure 7:
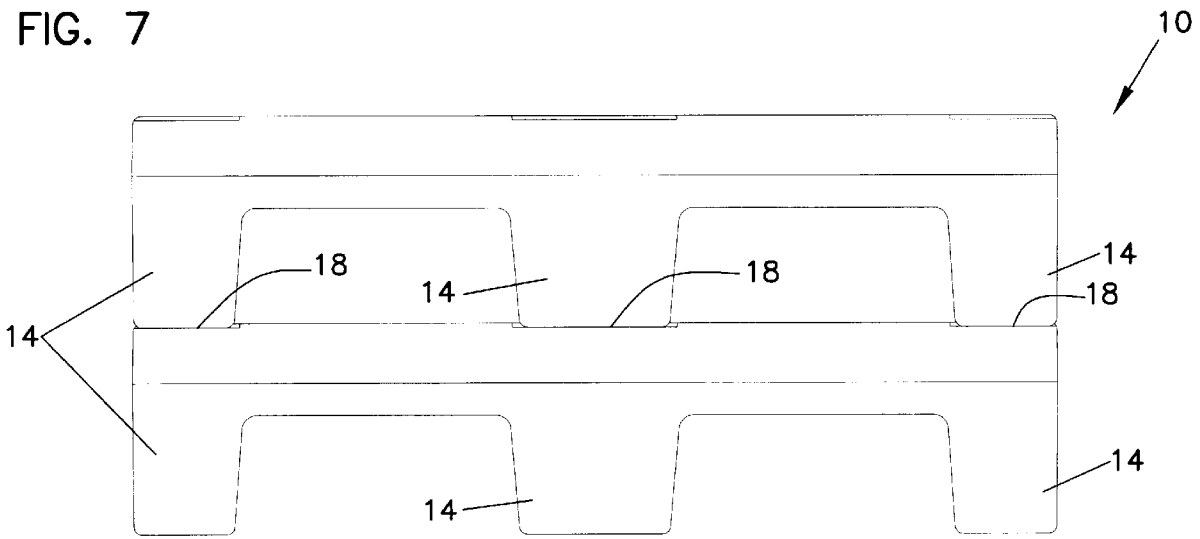
FIG. 7 is a side elevational view of pallets shown in FIG. 1 in an alternately inverted stacking pattern.
Figure 8:
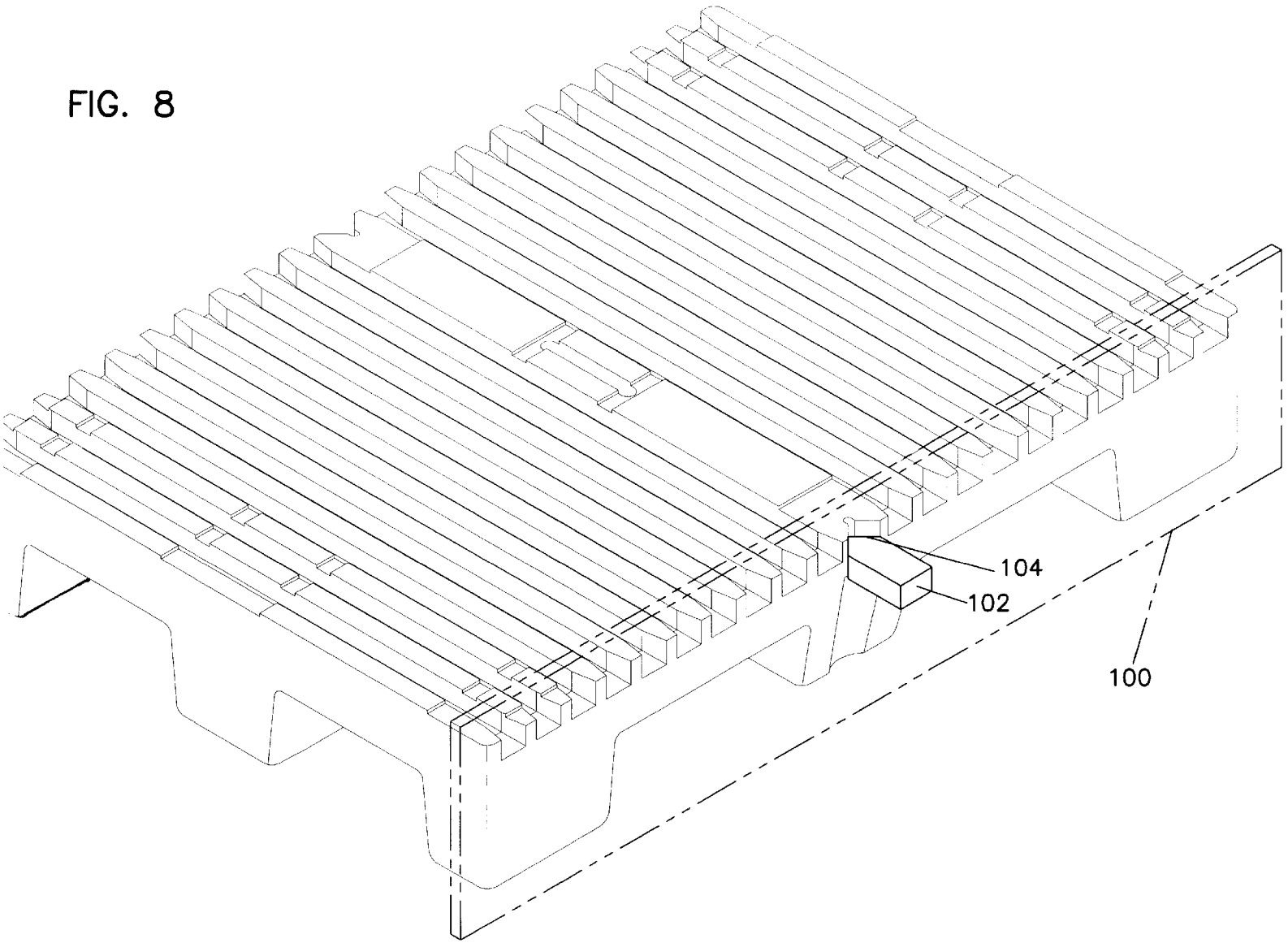
FIG. 8 is a perspective view of the pallet shown in FIG. 1 with an indexing element of an alignment device.
Figure 9:
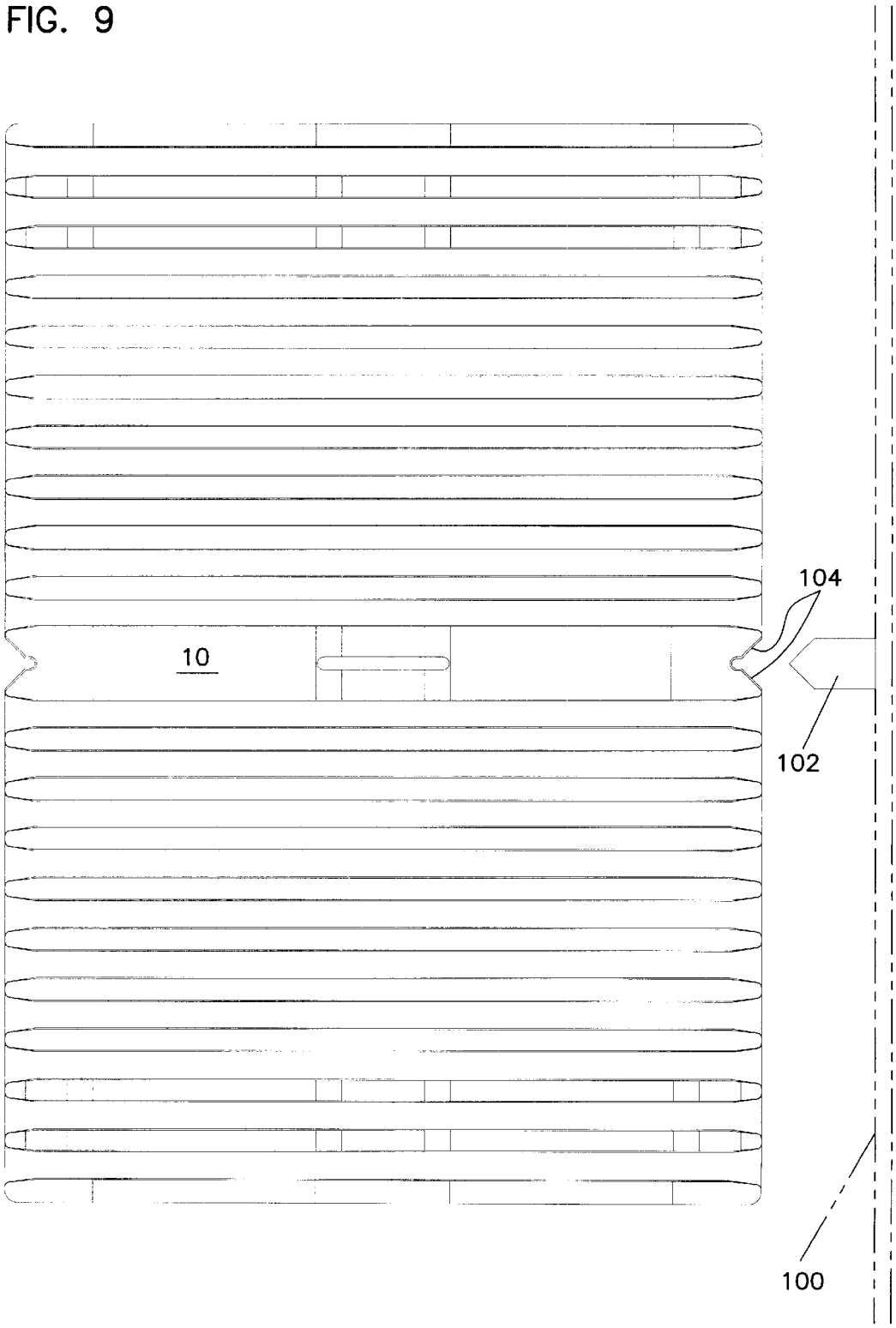
FIG. 9 shows a top plan view of the pallet shown in FIG. 1 with the stackable pallet and indexing element engaged.

Referring again to FIG. 1, the pallet 10 includes an alignment section 40 shown as a notch along opposed edges of the planar deck 12. The notches 40 are substantially "V" shaped and may include an enlarged tip portion 42. The alignment section is preferably positioned along the center line of the long edge of the deck 12. In this manner, more precise alignment is achieved as differences due to tolerances are measured from the center line rather than accumulating over the entire length of the pallet 10. Mistakes due to alignment from different ones of the two ends are also eliminated. The planar deck 12 has an alignment section 40 along both of the longer edges of the deck 12 in a preferred embodiment so that either of the opposed edges may be used for alignment. The alignment section 40 is configured for mating with an alignment member 102 of a stationary device 100 with which the pallet 10 is being aligned, as shown in FIGS. 6 and 7. The alignment member 102 has a substantially triangular end portion having angling surfaces 104. The pallet 10 is aligned by moving the deck so that the alignment section 40 engages the alignment member 102. As the angled sides of the notch portion 40 and the angling surfaces 104 engage one another, they provide for self-alignment as the pallet 10 is moved closer to the stationary device 100, as shown in FIG. 7. The system provides self-alignment and assures repeated identical positioning among all pallets 10 as they are aligned with the device 100. This allows precise placement of the load for handling equipment.

Figure 10:
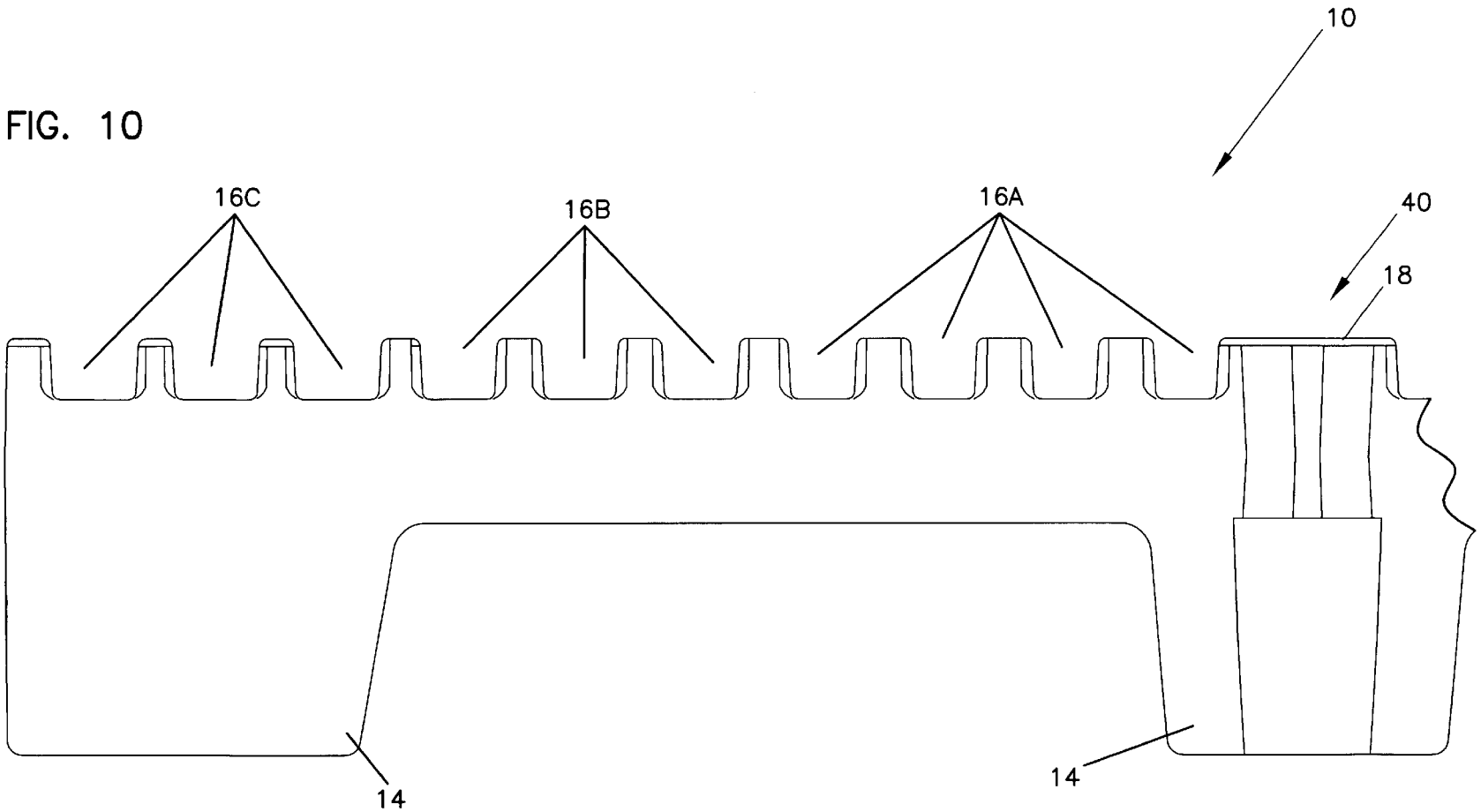
FIG. 10 shows an end details view of the ends of the channels of the stackable pallet shown in FIG. 1.

Referring now to FIG. 10, the channels 16 further from the alignment section 40 are wider than the channels closer to the alignment section. Channels 16A have a first width, channels 16B have a second width greater than the first width, and channels 16C have a third width greater the first or second width. In some instances, elongated tines, commonly known as swords, are in a fixed position when inserted into the channels 16 of the pallet 10. Gradually widening channels 16A, 16B and 16C allow for variations due to compounded tolerances in the channels furthest from the center of the pallet 10. The swords may be easily inserted as width of the channels 16 increases in a manner somewhat corresponding to increased variations from compounded tolerances. Moreover, since the alignment is based from the center of the pallet 10, the variations can only compound over half the length of the pallet 10, thereby decreasing the maximum variations as compared to alignment from one or the other of the ends. In a preferred embodiment, the centerlines of the channels 16A, 16B and 16C remain evenly spaced apart even though the channel width increases, as the swords are evenly spaced apart.

The alignment system provides a self-centering mechanism and provides for precise alignment while minimizing differences in tolerances or alignment from different ends of the pallet 10. The pallet 10 may be a light weight molded monolithic element that includes alignment features 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A pallet comprising:

a rectangular support deck having a substantially planar upper supporting surface including a plurality of channels formed therein extending across the pallet;

a plurality of support members extending from an underside of the deck;

a v-shaped alignment notch formed and centered along a first edge of the deck; wherein the first edge comprises an edge at a first end of the channels, and wherein channels spaced further from the alignment notch are wider than channels closer to the alignment notch.

2. A pallet according to claim 1, further comprising a second v-shaped alignment notch formed along a second edge of the deck at a second end of the channels.

3. A pallet according to claim 1, wherein the deck includes a central portion projecting substantially to the planar upper supporting surface and defining a top recess around the central portion extending to a depth no greater than the channels, wherein the central portion and associated top recess are substantially aligned with a support and member, wherein each support member defines a bottom recess substantially aligning with the central portion.

4. A pallet according to claim 1, further comprising support ribs formed in the underside of the support deck, and wherein the support ribs extend substantially perpendicular to the channels.

5. A pallet according to claim 1, wherein the underside of the deck includes cavities formed therein for receiving support members, whereby pairs of the pallets may be stacked with undersides opposing one another and the support members seating in corresponding cavities of the adjacent pallet.

6. A pallet according to claim 1, wherein the channels have graduated increasing widths from channels proximate the alignment notch to channels proximate ends of the pallet.

7. A pallet according to claim 1, further comprising a second v-shaped alignment notch formed at a center of a second edge opposite the first edge.

8. A method of aligning a pallet against a device, comprising:

providing a pallet having a substantially planar deck and an alignment section comprising a notch along at least a first edge, wherein the notch includes sides extending obliquely to the first edge;

providing a device having a tapered indexing portion complementary to the notch;

moving the pallet and the device relative to one another such that the alignment section engages the indexing portion;

sliding the pallet and device relative to one another so that the indexing portion guides the alignment section of the pallet to position the pallet in a predetermined position against the device.

9. A method according to claim 8, wherein the alignment section comprises a v-shaped notch and the complementary indexing portion comprises a tapered section interlocking with the notch.

10. A method according to claim 9, wherein the notch is provided at a center point of the first edge of the pallet.

11. A pallet comprising:

a rectangular support deck having a substantially planar upper supporting surface including a plurality of channels formed therein extending across the pallet, wherein the channels nearer ends of the pallet have a width greater than channels nearer a center of the pallet;

a plurality of support members extending from an underside of the deck;

an alignment portion formed along a first edge of the deck at a center point of the first edge, wherein the alignment portion includes first and second sides extending inward toward one another from the first edge at an oblique angle to the first edge.

12. A pallet according to claim 11, wherein the first edge comprises an edge at a first end of the channels.

13. A pallet according to claim 11, further comprising a second alignment portion formed along a second edge of the deck at a second end of the channels, wherein the second alignment portion includes first and second sides extending inward toward one another from the second edge at an oblique angle to the second edge.

14. A pallet according to claim 11, wherein each of said support members includes a central portion projecting substantially to the planar upper supporting surface and defining a top recess around the central portion extending to a depth no greater than the channels, wherein each support member defines a bottom recess aligning with the central portion.

15. A pallet according to claim 11, further comprising support ribs formed in the underside of the support deck, and wherein the support ribs extend substantially perpendicular to the channels.

16. A pallet comprising:

a rectangular support deck having a substantially planar upper supporting surface;

a plurality of support members extending from an underside of the deck;

an alignment portion formed along a first edge of the deck; and wherein the upper supporting surface includes a plurality of channels formed therein extending across the pallet, the channels having centerlines spaced equidistant from centerlines of adjacent channels and wherein channels nearer ends of the pallet have graduated widths increasing from the channels nearer a center of the pallet.

17. A pallet according to claim 16, wherein the alignment portion comprises a v-shaped alignment notch centered along the first edge of the deck.

18. A pallet according to claim 17, further comprising a second v-shaped alignment notch formed at a center of a second edge opposite the first edge.

* * * * *